US008177605B2

(12) United States Patent
Shim

(10) Patent No.: US 8,177,605 B2
(45) Date of Patent: May 15, 2012

(54) BOWLING BALL SURFACE TREATMENT DEVICE

(76) Inventor: Sang-Bae Shim, Namyangju-si (KR)

( * ) Notice: Subject to any disclaimer, the term of this patent is extended or adjusted under 35 U.S.C. 154(b) by 895 days.

(21) Appl. No.: 12/159,165

(22) PCT Filed: Dec. 13, 2006

(86) PCT No.: PCT/KR2006/005423
§ 371 (c)(1),
(2), (4) Date: Sep. 3, 2008

(87) PCT Pub. No.: WO2007/091775
PCT Pub. Date: Aug. 16, 2007

(65) Prior Publication Data

US 2009/0098809 A1 Apr. 16, 2009

(30) Foreign Application Priority Data

Feb. 10, 2006 (KR) ..... 10-2006-0013180
Jun. 23, 2006 (KR) ..... 10-2006-0056965

(51) Int. Cl.
*B24B 7/00* (2006.01)

(52) U.S. Cl. ..... 451/159; 451/267; 451/268; 451/271; 451/282; 451/283

(58) Field of Classification Search ..... 451/11, 451/49, 50, 158, 159, 267, 268, 269, 271, 451/282, 283; 15/21.2
See application file for complete search history.

(56) References Cited

U.S. PATENT DOCUMENTS 2,405,344 A * 8/1946 Cloutier ..... 451/50
2,420,988 A * 5/1947 Tholen ..... 15/97.1
2,479,898 A * 8/1949 Beaudette ..... 15/93.1
3,106,133 A * 10/1963 Arpaio, Jr. et al. ..... 409/178
3,341,982 A * 9/1967 Torresen ..... 451/446
3,654,655 A * 4/1972 Mitnick ..... 15/21.2
3,714,703 A * 2/1973 Maples ..... 29/560
3,971,164 A * 7/1976 Albin et al. ..... 451/283
(Continued)

FOREIGN PATENT DOCUMENTS

KR 100242493 B1 11/1999
(Continued)

OTHER PUBLICATIONS

International Search Report of Application No. PCT/KR2006/005423 mailed Mar. 14, 2007.

*Primary Examiner* — Eileen P. Morgan
(74) *Attorney, Agent, or Firm* — Lowe Hauptman Ham & Berner LLP

(57) ABSTRACT

A bowling ball surface treatment device for abrading, polishing or cleansing a bowling ball includes a housing, a ball displacing unit movably mounted to the housing for holding the bowling ball in a rotatable manner and for reciprocatingly displacing the bowling ball between a temporary waiting region and a surface treatment region, a surface treatment disc for supporting and spinning the bowling ball in the surface treatment region, the surface treatment disc having a surface treatment element for making frictional contact with the bowling ball, a temporary support disc for temporarily supporting the bowling ball in the temporary waiting region when the bowling ball is moved out of the surface treatment region, and a disc drive unit for rotatingly driving the surface treatment disc and the temporary support disc.

18 Claims, 9 Drawing Sheets

U.S. PATENT DOCUMENTS

| | | | | |
|---|---|---|---|---|
| 5,484,329 | A * | 1/1996 | Engelbrektson | 451/523 |
| 5,613,896 | A * | 3/1997 | Haus et al. | 451/50 |
| 6,077,148 | A * | 6/2000 | Klein et al. | 451/11 |
| 6,186,875 | B1 * | 2/2001 | Cook et al. | 451/268 |
| 6,746,315 | B2 * | 6/2004 | Klukos | 451/50 |
| 6,761,622 | B2 | 7/2004 | Nam | |
| 7,063,607 | B2 | 6/2006 | Sim | |
| 7,585,203 | B1 * | 9/2009 | Shim | 451/5 |
| 7,892,073 | B1 * | 2/2011 | Smania et al. | 451/50 |
| 2002/0168925 | A1 * | 11/2002 | Klukos | 451/49 |
| 2003/0049996 | A1 * | 3/2003 | Nam | 451/178 |
| 2006/0111029 | A1 * | 5/2006 | Sim | 451/491 |

FOREIGN PATENT DOCUMENTS

| | | | |
|---|---|---|---|
| KR | 20030061924 | A | 7/2003 |
| KR | 20040002753 | A | 1/2004 |

* cited by examiner

[Fig. 1]
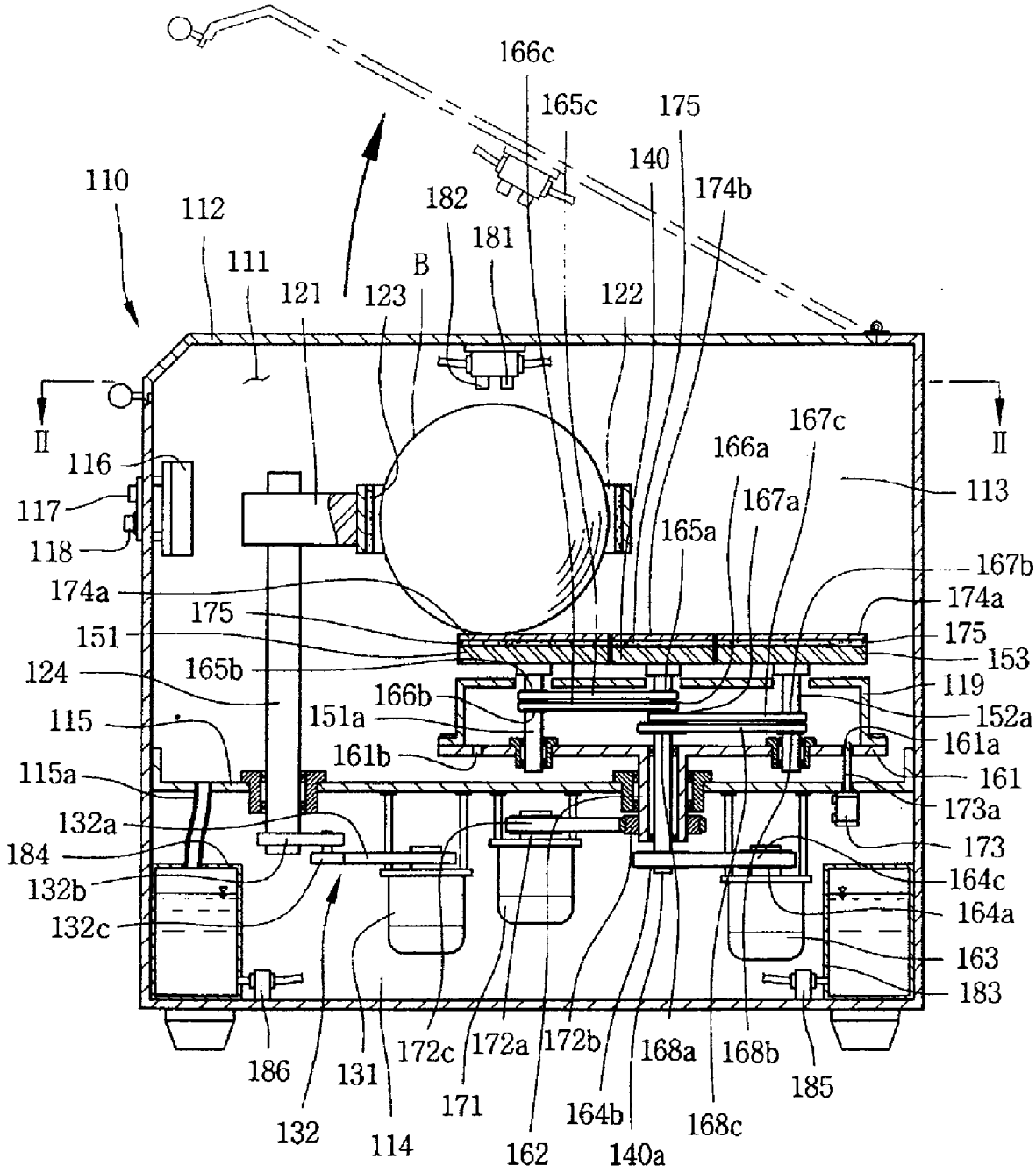

[Fig. 2]
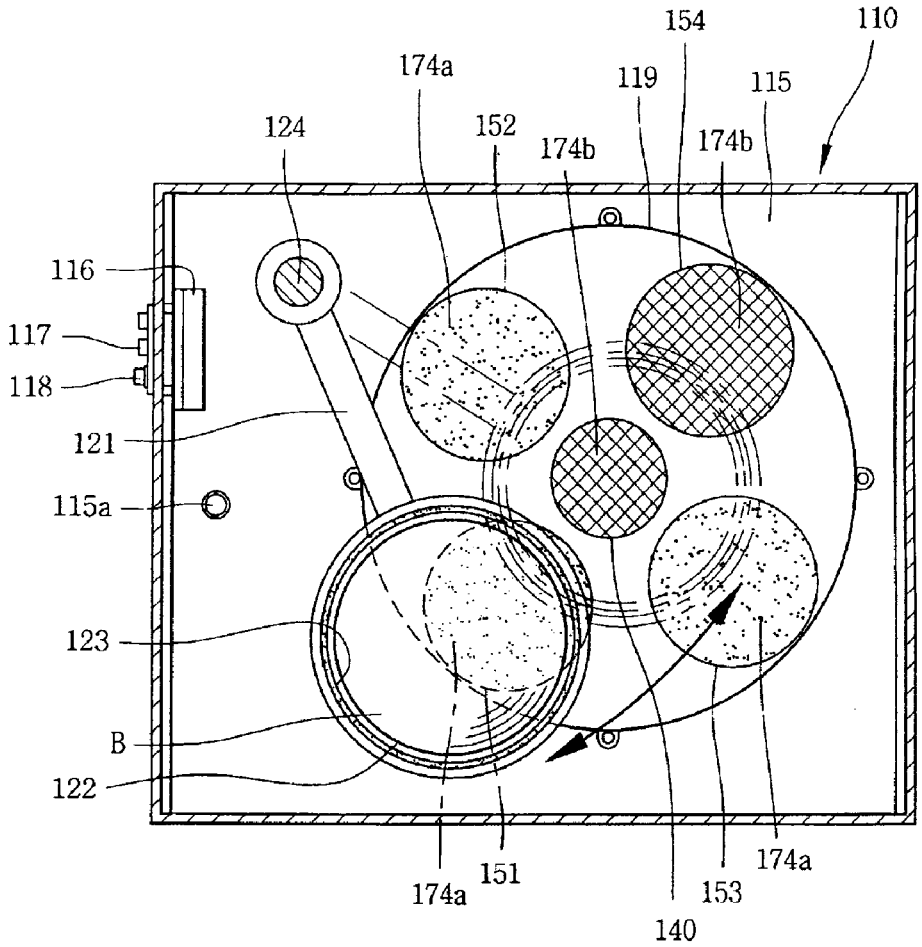
[Fig. 3]
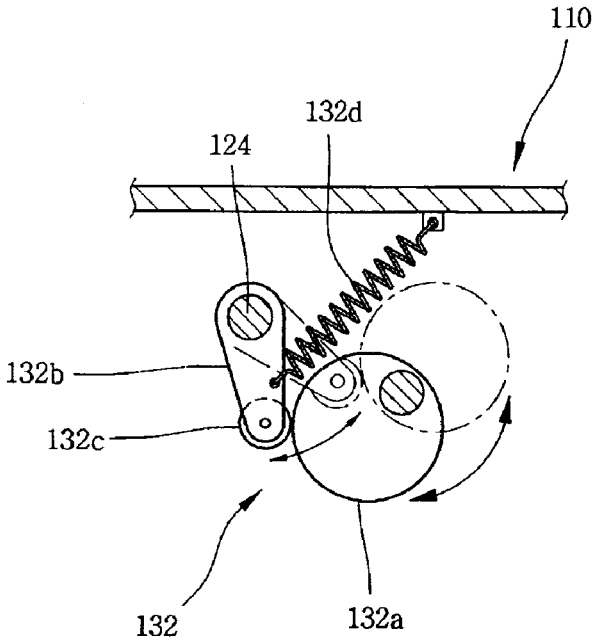

[Fig. 4]
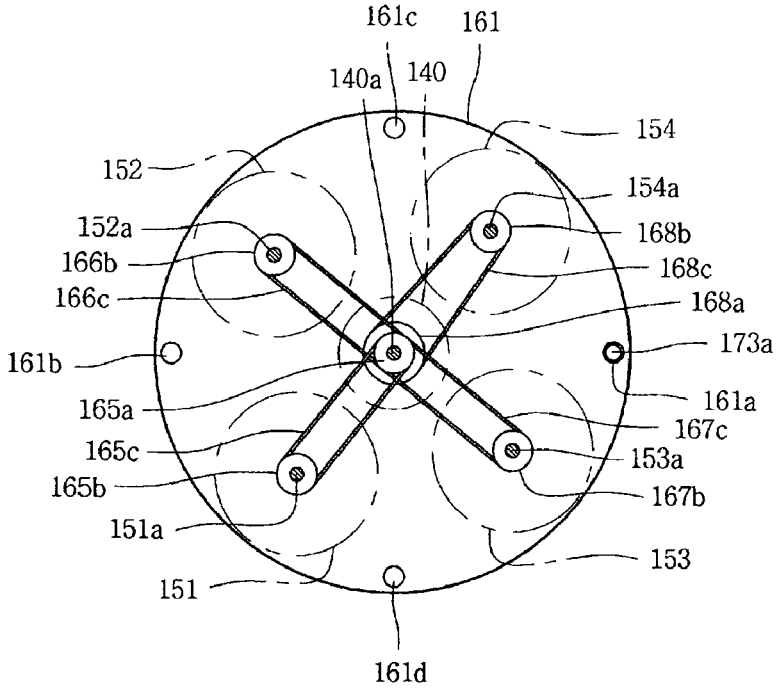
[Fig. 5]
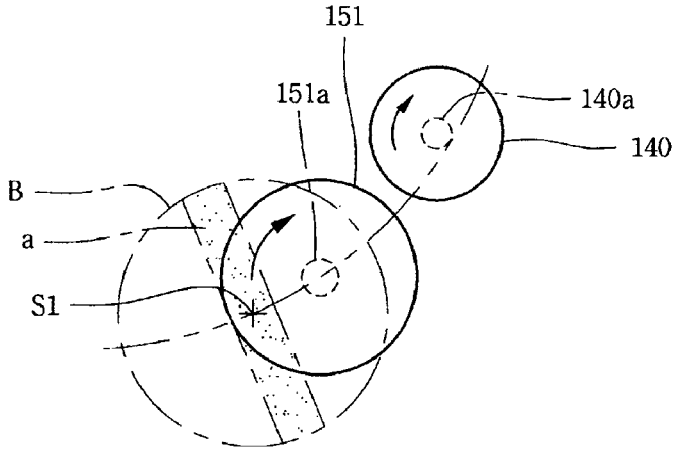
[Fig. 6]
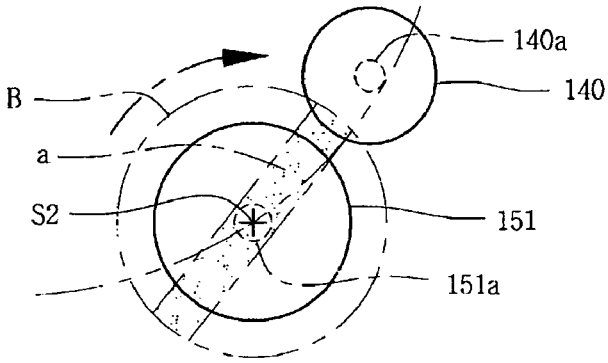

[Fig. 7]
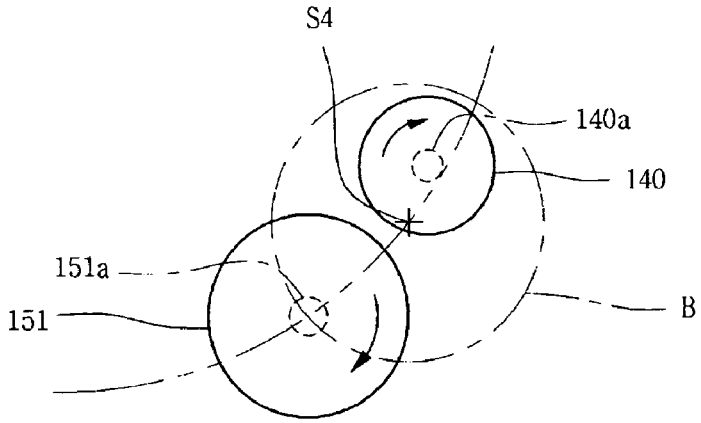
[Fig. 8]
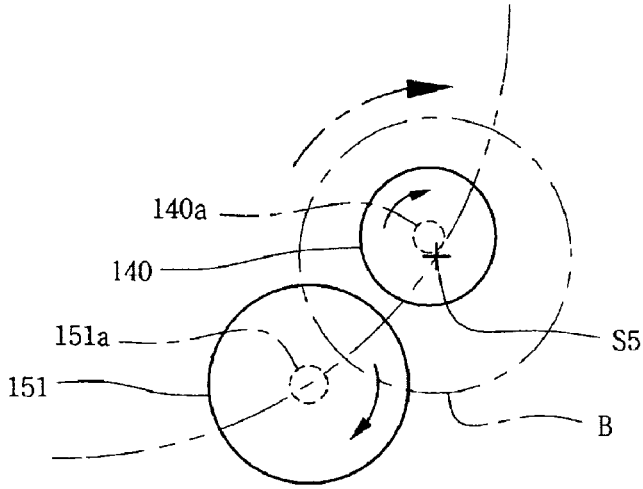
[Fig. 9]
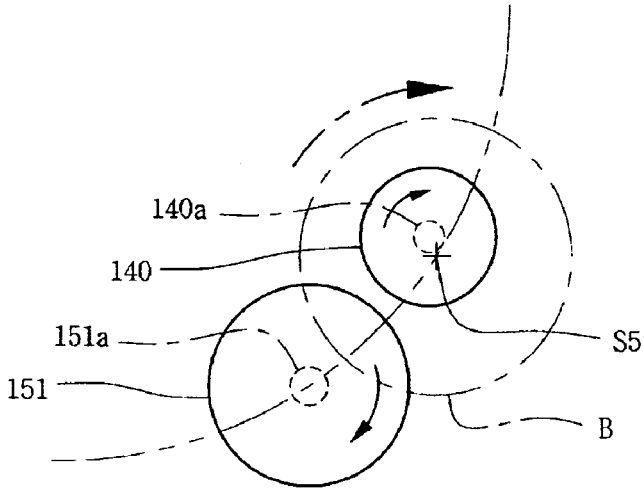

[Fig. 10]
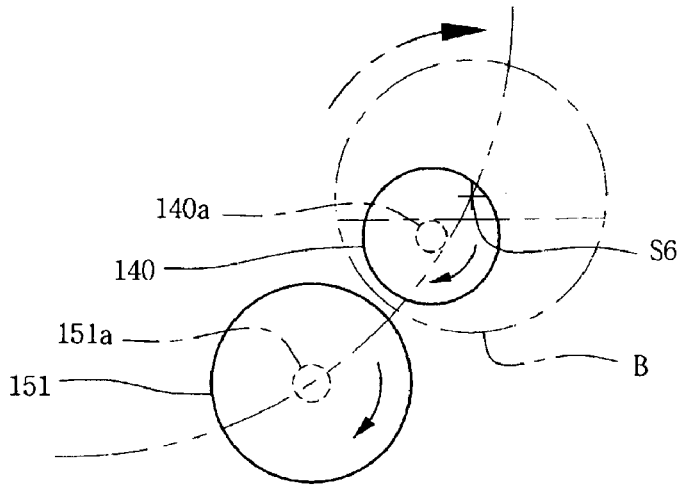
[Fig. 11]
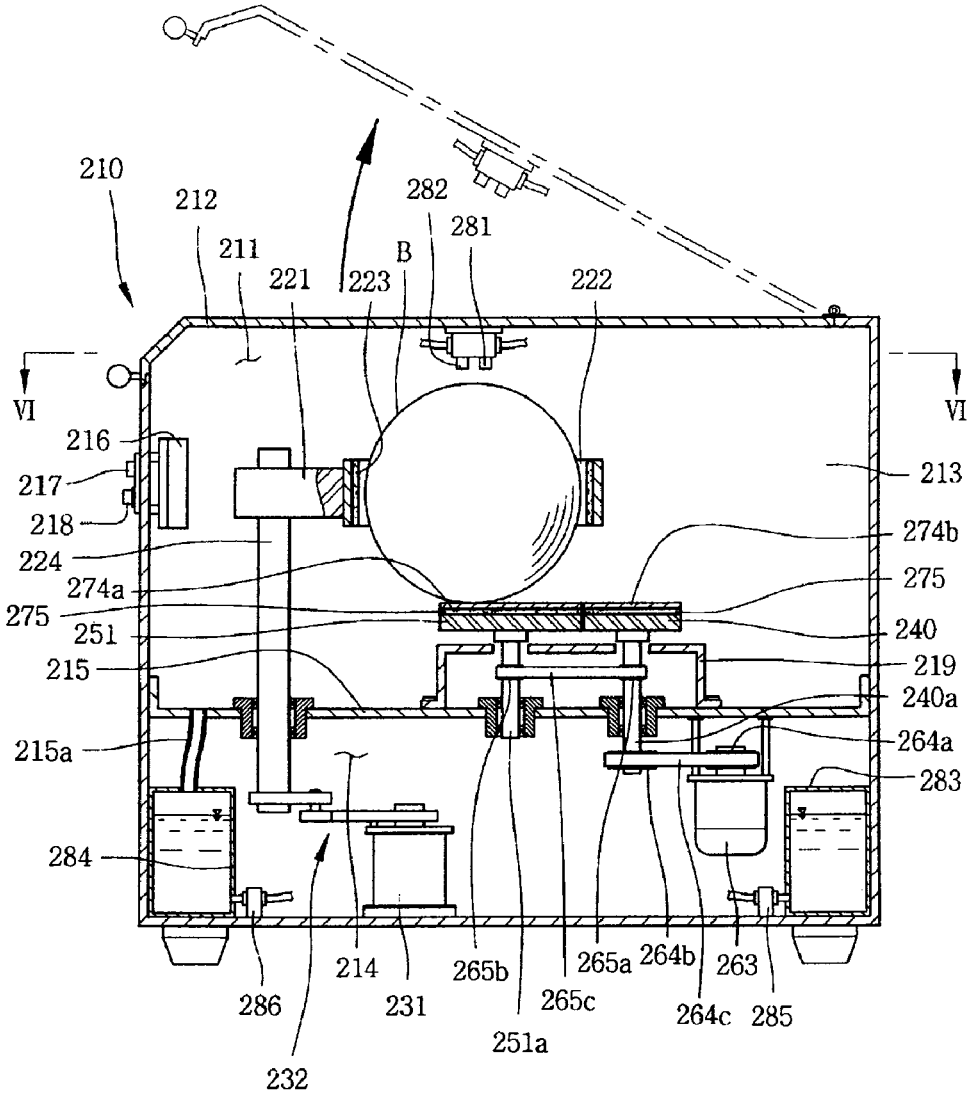

[Fig. 12]
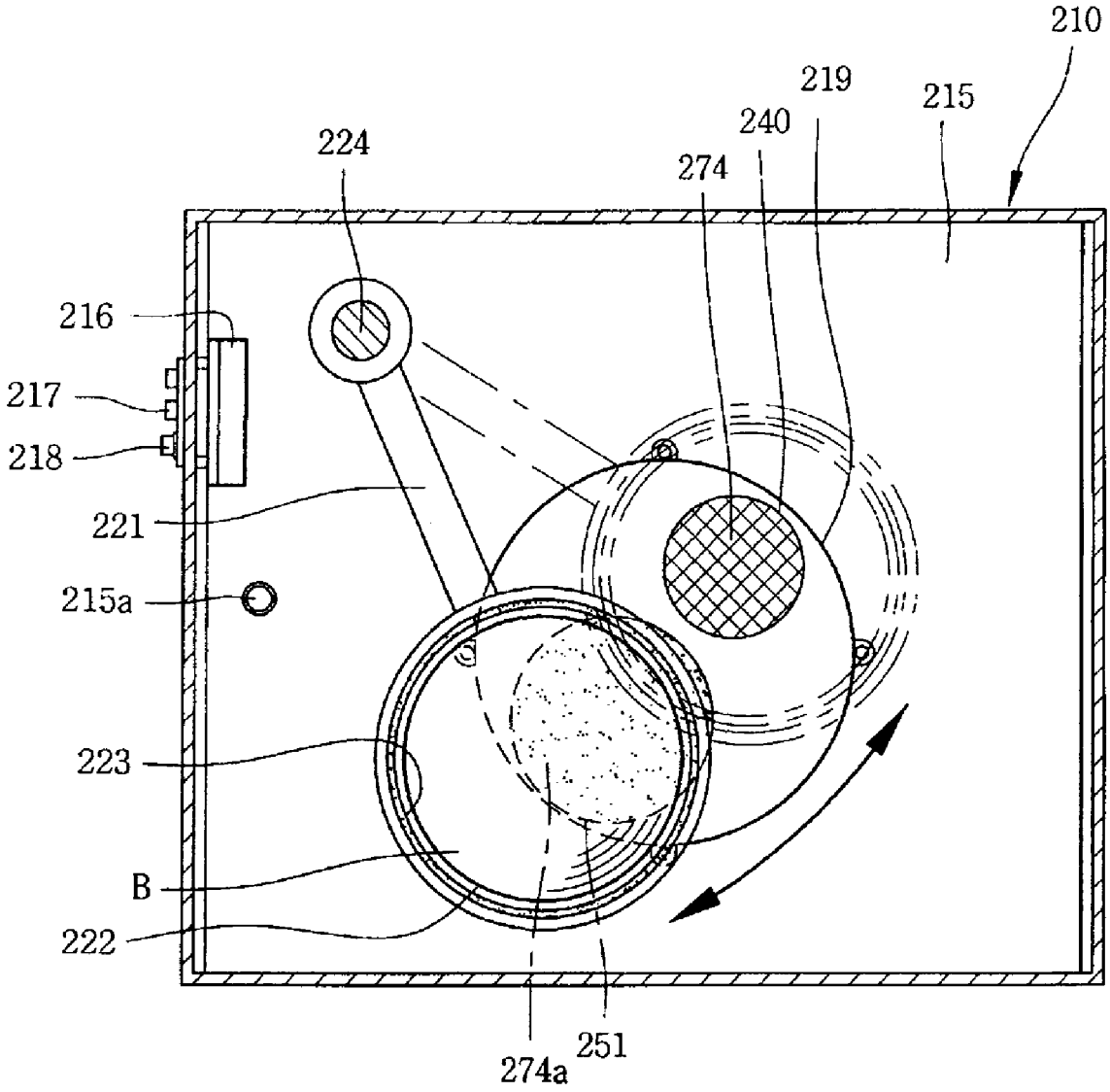

[Fig. 13]
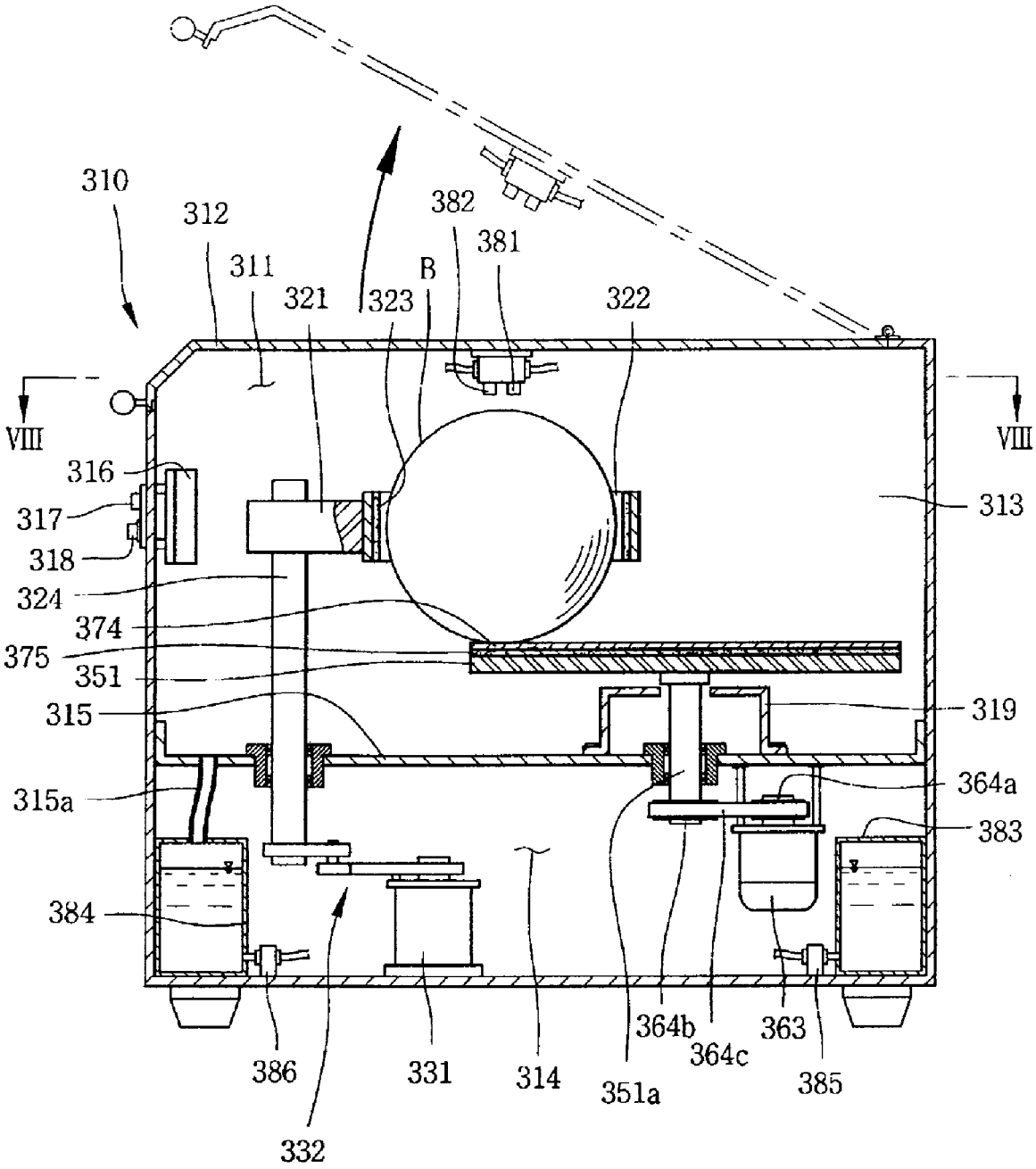

[Fig. 14]
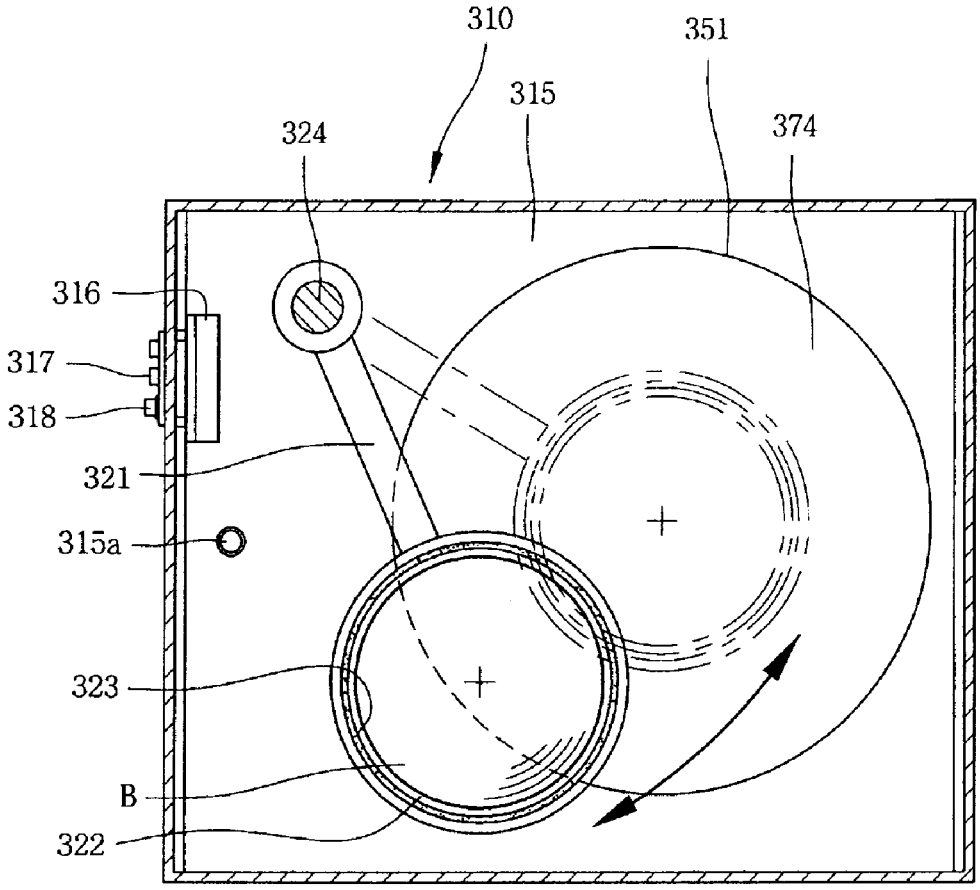
[Fig. 15]
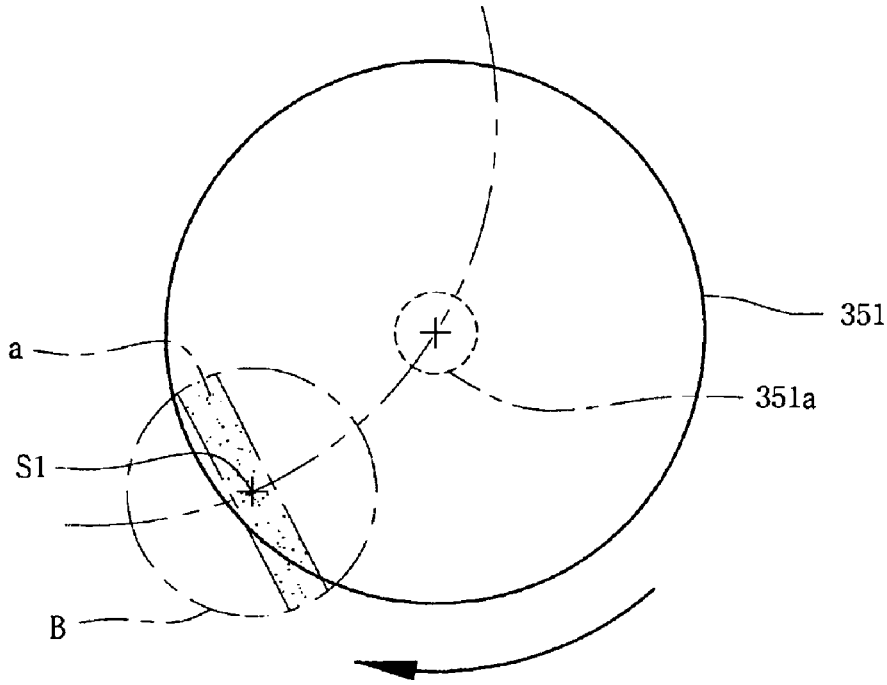

[Fig. 16]
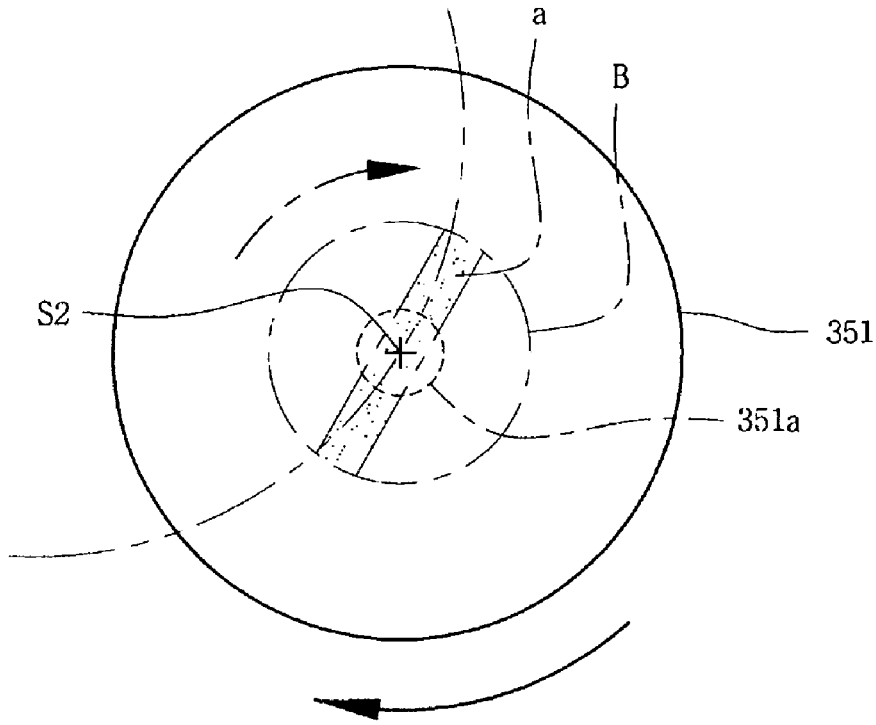
[Fig. 17]
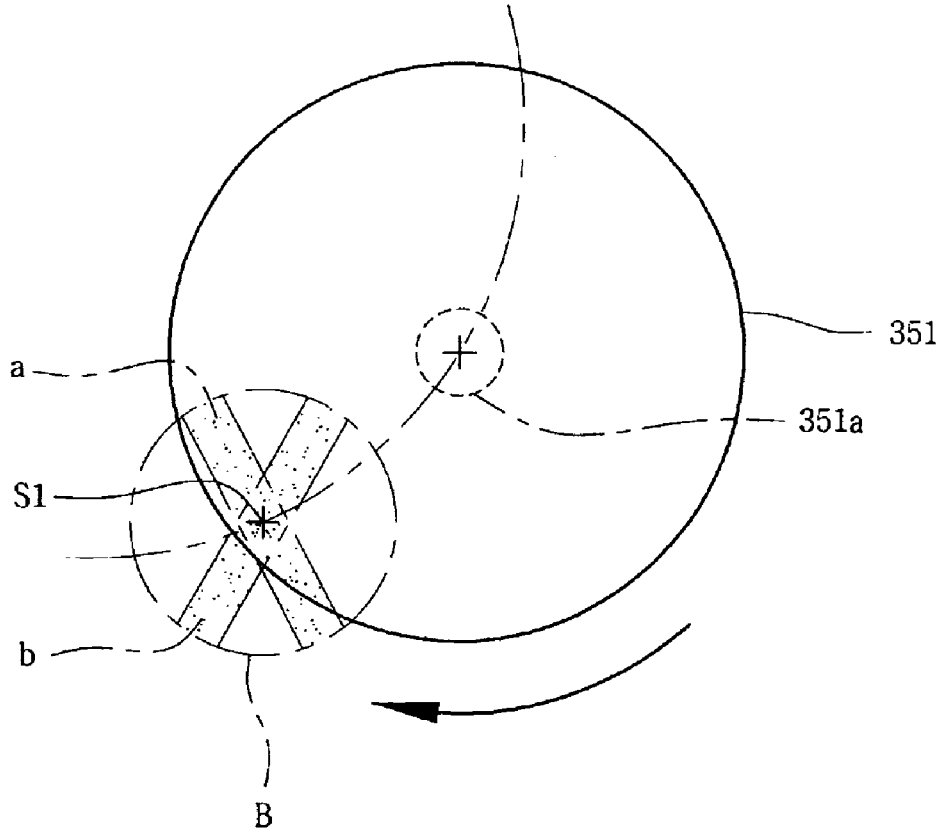

BOWLING BALL SURFACE TREATMENT DEVICE

RELATED APPLICATIONS

The present application is based on, and claims priority from, International Application PCT/KR2006/005423, filed on Dec. 13, 2006, Korean Application No. 10-2006-0056965 filed on Jun. 23, 2006, and Korean Application No. 10-2006-0013180 filed Feb. 10, 2006, the disclosures of which are hereby incorporated by reference herein in their entirety.

TECHNICAL FIELD

The present invention relates to a bowling ball surface treatment device and, more specifically, to a bowling ball surface treatment device for abrading, polishing or cleansing a surface of a spherical object such as a bowling ball or the like while causing the spherical object to rotate about continuously varying rotational axes in many different directions.

BACKGROUND ART

Frictional rolling contact between a bowling ball and a lane often leaves irregular wear portions or scratches on a surface of the bowling ball. In particular, the bowling ball tends to make contact with the lane substantially at the same circumferential area thereof, which gives rise to unbalanced wear of the bowling ball. In addition to the scratched or unevenly worn bowling ball looking ugly, use of the scratched or unevenly worn bowling ball makes it difficult for a bowler to exercise, e.g., spin skills at his or her desire due mainly to the unpredictable movement of the bowling ball. As a result, the scratch and the unbalanced wear may adversely affect the score of a bowling game, thus reducing amusement of the game played. Thus, the bowling ball needs to be periodically abraded into a perfect spherical shape.

There are a number of prior art references that disclose a device for automatically abrading a bowling ball. One of them is U.S. Pat. No. 5,613,896 that teaches a bowling ball resurfacing machine including three shafts each pivotally disposed at an angle of 120 in such a manner as to support a bowling ball therein, three motors for rotating the corresponding shaft in a forward/reverse direction, and three cone-shaped abrading cups mounted on the shafts. Although this bowling ball resurfacing machine has its own advantages, it suffers from a drawback in that a rolling direction or a rotation axis of the bowling ball cannot be vigorously changed during a resurfacing process.

Another prior art reference is U.S. Pat. No. 7,063,607 disclosing a bowling ball resurfacing apparatus that includes a housing, first and second vertical support rollers mounted to the housing for rotation about parallel vertical axes, each of the vertical support rollers adapted to make contact with the surface of the bowling ball at one lateral bottom side of the bowling ball, first and second horizontal support rollers mounted to the housing for supporting the bowling ball in cooperation with the vertical support rollers, each of the horizontal support rollers rotatable about horizontal axes and adapted to make contact with the surface of the bowling ball at the other lateral bottom side of the bowling ball, drive motors for causing the support rollers to rotate, and a grinding-and-polishing wheel assembly for making frictional contact with the surface of the bowling ball to grind or polish the bowling ball.

The prior art devices noted above are capable of substantially evenly abrading or polishing the surface of the bowling ball by rotating the bowling ball in different directions. However, the prior art devices leave a room for improvement because they are structurally complicated, difficult and costly to fabricate, and highly susceptible to trouble.

DISCLOSURE OF INVENTION

Technical Problem

In view of the above-mentioned or other problems inherent in the prior art devices, it is an object of the present invention to provide a bowling ball surface treatment device that has a relatively simple structure and shows improved durability for an extended period of operating time.

Another object of the invention is to provide a bowling ball surface treatment device capable of abrading, polishing and cleansing a surface of a bowling ball with increased roundness.

Technical Solution

In accordance with the invention, there is provided a bowling ball surface treatment device for abrading, polishing or cleansing a bowling ball, comprising: a housing; a ball displacing means movably mounted to the housing for holding the bowling ball in a rotatable manner and for reciprocatingly displacing the bowling ball between a temporary waiting region and a surface treatment region in which the bowling ball is subject to a surface treatment; a surface treatment disc means for supporting and spinning the bowling ball in the surface treatment region, the surface treatment disc means arranged such that the bowling ball makes rolling contact with different portions of the surface treatment disc means as the bowling ball is displaced between the temporary waiting region and the surface treatment region, the surface treatment disc means having a surface treatment element for making frictional contact with the bowling ball to abrade, polish or cleanse the bowling ball; a temporary support means for temporarily supporting the bowling ball in the temporary waiting region when the bowling ball is moved out of the surface treatment region; and a disc drive means for rotatingly driving the surface treatment disc means.

Advantageous Effects

With the bowling ball surface treatment device of the present invention, a bowling ball is repeatedly reciprocated between a temporary waiting region and a surface treatment region, in which reciprocating process the bowling ball rotates about a multiplicity of different rotational axes in random directions. This makes it possible to evenly abrade, polish or cleanse the whole surface of the bowling ball with increased roundness. Furthermore, the bowling ball surface treatment device of the present invention is relatively simple in structure and shows improved durability for an extended period of operating time. This allows the bowling ball surface treatment device to be fabricated in a cost-effective manner and to be used with reduced probability of trouble.

The term "temporary waiting region" used herein means a region in which a bowling ball stays temporarily without being subject to significant surface treatment but does not exclude a possibility that a surface treatment occurs in the temporary waiting region. The term "surface treatment region" used herein means a region in which a bowling ball is rotatingly driven and a surface treatment for the bowling ball is performed predominantly.

BRIEF DESCRIPTION OF THE DRAWINGS

The above and other objects and features of the present invention will become apparent from the following description of preferred embodiments given in conjunction with the accompanying drawings.

FIG. 1 is a side elevational section view showing a bowling ball surface treatment device in accordance with a first embodiment of the present invention.

FIG. 2 is a cross sectional view of the bowling ball surface treatment device of the first embodiment taken along line II-II in FIG. 1.

FIG. 3 is a partially cutaway top view illustrating an arm drive mechanism employed in the bowling ball surface treatment device of the first embodiment.

FIG. 4 is a partially cutaway top view illustrating an intermittent rotary drive mechanism employed in the bowling ball surface treatment device of the first embodiment.

FIGS. 5 through 10 are views depicting a surface treatment process performed by the bowling ball surface treatment device of the first embodiment.

FIG. 11 is a side elevational section view showing a bowling ball surface treatment device in accordance with a second embodiment of the present invention.

FIG. 12 is a cross sectional view of the bowling ball surface treatment device of the second embodiment taken along line VI-VI in FIG. 11.

FIG. 13 is a side elevational section view showing a bowling ball surface treatment device in accordance with a third embodiment of the present invention.

FIG. 14 is a cross sectional view of the bowling ball surface treatment device of the third embodiment taken along line VIII-VIII in FIG. 13.

FIGS. 15 through 17 are views depicting a surface treatment process performed by the bowling ball surface treatment device of the third embodiment.

BEST MODE FOR CARRYING OUT THE INVENTION

Preferred Embodiments of a bowling ball surface treatment device in accordance with the present invention will now be described in detail with reference to the accompanying drawings.

Mode for the Invention

First Embodiment

FIGS. 1 through 10 show a bowling ball surface treatment device in accordance with a first embodiment of the present invention. Referring first to FIGS. 1 and 2, the bowling ball surface treatment device of the first embodiment includes a housing 110 having an access opening 111 through which a bowling ball B is put into or taken out from the housing 110. The access opening 111 is openably closed by a lid 112. Within the housing 110, there are provided a surface treatment compartment 113 in which the bowling ball B is abraded, polished or cleansed when it is inserted through the access opening 111 and a drive compartment 114 which accommodates various drive units. The surface treatment compartment 113 and the drive compartment 114 are arranged one above the other and isolated from each other by a partition plate 115.

A control board 116 for controlling the bowling ball surface treatment device is attached to an internal side surface of the housing 110, whereas a series of push buttons 117 for operation of the control board 116 and a timer 118 are arranged on an external side surface of the housing 110 in alignment with the control board 116.

Within the surface treatment compartment 113 of the housing 110, there is provided a ball displacing means for holding the bowling ball B in a rotatable manner and displacing the bowling ball B between a temporary waiting region in which the bowling ball B is subject to no significant surface treatment and a surface treatment region in which the bowling ball B is subject to a surface treatment such as abrading, polishing or cleaning.

Referring to FIG. 2, the ball displacing means includes an arm member 121 for holding the bowling ball B in a rotatable manner. The arm member 121 is provided at its distal end with a retainer rim 122 for rotatably receiving the bowling ball B. The retainer rim 122 has an inner diameter far greater than the bowling ball B such that the bowling ball B can be freely rotated within the retainer rim 122. A shock-absorbing member 123 made of, e.g., a spongy material, is attached to an inner circumferential surface of the retainer rim 122.

The arm member 121 is provided at its proximal end with an arm rotation shaft 124 extending downwardly in a vertical direction. The arm rotation shaft 124 is mounted to the partition plate 115 for rotation about a vertical axis. Thus, the arm member 121 is allowed to make a swing movement together with the arm rotation shaft 124 within a predetermined angular extent.

The ball displacing means further includes an arm drive means for repeatedly reciprocating the arm member 121 between a first position (indicated by a single-dotted chain line in FIG. 2) corresponding to the temporary waiting region and a second position (indicated by a solid line in FIG. 2) corresponding to the surface treatment region.

In this regard, the temporary waiting region is a spatial region lying just below the retainer rim 122 when the arm member 121 is in the first position (chain line position), and the surface treatment region is a spatial region lying just blow the retainer rim 122 when the arm member 121 is in the second position (solid line position).

The arm drive means for repeatedly reciprocating the arm member 121 includes an arm drive motor 131 provided within the drive compartment 114 and a motion converter mechanism 132 for converting rotation of the arm drive motor 131 to forward and reverse angular rotation of the arm rotation shaft 124.

As illustrated in FIG. 3, the motion converter mechanism 132 includes a disc-shaped eccentric cam 132*a* fixedly secured to an output shaft of the arm drive motor 131, a swing lever 132*b* fixed to the arm rotation shaft 124, a roller 132*c* rotatably attached to a free end of the swing lever 132*b* for making contact with an outer cam surface of the eccentric cam 132*a*, and a tension spring 132*d* interconnecting the swing lever 132*b* and the housing 110 in such a manner as to resiliently bias the roller 132*c* into rolling contact with the outer cam surface of the eccentric cam 132*a*.

By virtue of the motion converter mechanism 132 configured as above, rotation of the arm drive motor 131 is converted to a swing motion of the swing lever 132*b* about the arm rotation shaft 124 by means of the eccentric cam 132*a*. In response, the arm member 121 is swung between the first and second positions to thereby reciprocatingly displace the bowling ball B from the temporary waiting region to the surface treatment region and vice versa. A swing angle at which the swing lever 132*b* and the arm member 121 are swung is decided by setting an eccentricity of the eccentric cam 132*a*. Operation of the arm drive motor 131 is controlled by the control board 116. Preferably, the arm drive motor 131 is controlled to turn at such a speed that the arm member 121 can make one reciprocating swing motion every 1-3 seconds.

A temporary support disc 140 is arranged in the temporary waiting region of the surface treatment compartment 113. A plurality of, e.g., first to fourth, surface treatment discs 151-154 are arranged around the temporary support disc 140 in such a manner that one of the surface treatment discs 151-154 can be selectively brought into the surface treatment region. The temporary support disc 140 and the surface treatment discs 151-154 are adapted to support a lower surface of the bowling ball B and are rotatable about the corresponding one of center shafts 140*a* and 151*a*-154*a* extending downwardly in a vertical direction. Although the surface treatment discs 151-154 are four in number according to the present embodiment, the number of the surface treatment discs 151-154 is not limited thereto but may be more or lesser depending on design requirements.

The respective center shafts 151*a*-154*a* of the first to fourth surface treatment discs 151-154 are rotatably supported on an intermittently revolving turntable 161 which in turn is rotatably fitted to the partition plate 115. The turntable 161 is provided at its center with a hollow shaft 162 extending downwardly through the partition plate 115 into the drive compartment 114. The hollow shaft 162 is rotatably supported by the partition plate 115.

The center shaft 140*a* of the temporary support disc 140 extends downwardly through the hollow shaft 162 of the turntable 161 into the drive compartment 114 and is rotatably supported by the hollow shaft 162. In this connection, the respective center shafts 151*a*-154*a* of the first to fourth surface treatment discs 151-154 are arranged at an equal interval along an imaginary circle that passes through the surface treatment region and has a center point coinciding with the center shaft 140*a* of the temporary support disc 140. Thus, intermittent angular revolution of the turntable 161 brings one of the first to fourth surface treatment discs 151-154 into the surface treatment region in an intermittently driven manner.

The temporary support disc 140 and the first to fourth surface treatment discs 151-154 are rotatingly driven by virtue of a disc drive means provided within the drive compartment 114, and the turntable 161 is intermittently revolved at a right angle by means of an intermittent drive means provided within the drive compartment 114.

The disc drive means includes a disc drive motor 163 arranged in the drive compartment 114 for rotating the center shaft 140*a* of the temporary support disc 140. Rotation of the disc drive motor 163 is transferred to the center shaft 140*a* of the temporary support disc 140 through a power transmission mechanism that consists of a pair of pulleys 164*a* and 164*b* and a belt 164*c* wound therearound.

First to fourth driving pulleys 165*a*-168*a* are fixedly secured to the center shaft 140*a* of the temporary support disc 140 and are operatively connected, by means of first to fourth belts 165*c*-168*c*, to first to fourth driven pulleys 165*b*-168*b* fixed to the center shafts 151*a*-154*a* of the first to fourth surface treatment discs 151-154. Thus, upon rotation of the disc drive motor 163, the first to fourth surface treatment discs 151-154 and the temporary support disc 140 are rotated simultaneously.

The disc drive means noted above serves to rotate the temporary support disc 140 and the first to fourth surface treatment discs 151-154 at a high speed, thereby causing the bowling ball B to be rotatingly driven by one of the temporary support disc 140 and the first to fourth surface treatment discs 151-154 in the temporary waiting region or the surface treatment region. Operation of the disc drive means is controlled by the control board 116 in the manner as preset by use of the push buttons 117. It would be preferred that the temporary support disc 140 and the first to fourth surface treatment discs 151-154 are rotated at a speed of about 500-1,200 rpm.

The fourth driving pulley 168*a*, which is positioned lowermost among the first to fourth driving pulleys 165*a*-168*a*, has an effective diameter greater than that of the first to third driving pulleys 165*a*-168*a* so that the fourth surface treatment disc 154 can rotate faster than the first to third surface treatment discs 151-153. In the present embodiment, the first to third surface treatment discs 151-153 rotating at a relatively low speed are used to abrade the bowling ball B, while the fourth surface treatment disc 154 rotating at a relatively high speed is used for the purpose of polishing the bowling ball B.

The intermittent drive means includes an intermittent drive motor 171 arranged in the drive compartment 114 for rotating the hollow shaft 162 of the turntable 161, the operation of which is controlled by the control board 116. Rotational of the intermittent drive motor 171 is transferred to the hollow shaft 162 of the turntable 161 by means of a pair of pulleys 172*a* and 172*b* and a belt 172*c* wound therearound.

In the present embodiment, the bowling ball surface treatment device further includes a disc positioning means that assists in accurately positioning one of the first to fourth surface treatment discs 151-154 in the surface treatment region. As best shown in FIGS. 1 and 4, the disc positioning means consists of a solenoid 173 with a re-tractable plunger 173*a* and four positioning holes 161*a*-161*d* formed in the turntable 161.

The four positioning holes 161*a*-161*d* have a size great enough to receive the re-tractable plunger 173*a* and are arranged at an equal interval in exact alignment with the first to fourth surface treatment discs 151-154 along an imaginary circle whose center point coincides with the center shaft 140*a* of the temporary support disc 140. The solenoid 173 is attached to the partition plate 115 in such a position as to ensure that the retractable plunger 173*a* is inserted into one of the four positioning holes 161*a*-161*d*. Operation of the solenoid 173 is controlled by the control board 116.

At the time when one of the first to fourth surface treatment discs 151-154 is placed in the surface treatment region, the retractable plunger 173*a* of the solenoid 173 is extended and inserted into the corresponding one of the positioning holes 161*a*-161*d* of the turntable 161, thereby exactly positioning the selected one of the surface treatment discs 151-154 in the surface treatment region and holding the turntable 161 against any inadvertent revolution.

Surface treatment elements for making frictional contact with the surface of the bowling ball B to perform a surface treatment is replaceably attached to the top surfaces of the temporary support disc 140 and the first to fourth surface treatment discs 151-154. In the present embodiment, the surface treatment elements are comprised of circular abrasive fabrics 174*a* attached to the first to third surface treatment discs 151-153 and circular rubbing fabrics 174*b* attached to the fourth surface treatment disc 154 and the temporary support disc 140. Each of the abrasive fabrics 174*a* is made of a sandpaper coated with abrasive grits or the like, which exhibits increased abrading performance, and each of the rubbing fabrics 174*b* is made of a woven cotton fabric or the like, which shows increased polishing and cleaning performance. The abrasive fabrics 174*a* attached to the first to third surface treatment discs 151-153 are used in abrading the bowling ball B and have a large grain size, a medium grains size and a fine grain size, respectively, so that the first to third surface treatment discs 151-153 can abrade the bowling ball B in different coarseness. The rubbing fabric 174*b* attached to the fourth surface treatment disc 154 serves to polish and cleanse the bowling ball B, while the rubbing fabric 174*b* attached to the temporary support disc 140 serves primarily as a friction member.

Shock-absorbing members 175 made of, e.g., a sponge, are provided between the respective discs 140 and 151-154 and the respective fabrics 174*a* and 174*b*. The shock-absorbing members 175 serve to absorb a shock which would be generated in the process of abrading, polishing or cleansing the bowling ball B and also serve to increase a contact area between the bowling ball B and the respective fabrics 174*a* and 174*b*. The shock-absorbing members 175 are replaceably attached to the respective discs 140 and 151-154 by means of a Velcro fastener or other suitable fastener means and, similarly, the respective abrasive and rubbing fabrics 174*a* and 174*b* are replaceably attached to the corresponding shock-absorbing members 175 by means of a Velcro fastener or other suitable fastener means.

In the present embodiment, the bowling ball surface treatment device further includes a surface treatment solution supply means for supplying surface treatment solution to the bowling ball B while the latter is subject to a surface treatment. The surface treatment solution supply means includes an abrading solution supply device and a polishing-and-cleansing solution supply device. The abrading solution supply device includes an abrading solution spray nozzle 181 attached to the lid 112 for spraying abrading solution, e.g., a mixture of fluid and fine grits, toward the bowling ball B, an abrading solution storage tank 183 arranged within the drive compartment 114, and an abrading solution pump 185 arranged within the drive compartment 114 for feeding pressurized abrading solution to the abrading solution spray nozzle 181. The polishing-and-cleansing solution supply device includes a polishing-and-cleansing solution spray nozzle 182 attached to the lid 112 for spraying polishing-and-cleansing solution, e.g., water, toward the bowling ball B, a polishing-and-cleansing solution storage tank 184 arranged within the drive compartment 114, and a polishing-and-cleansing solution pump 186 arranged within the drive compartment 114 for feeding pressurized polishing-and-cleansing solution to the polishing-and-cleansing solution spray nozzle 182.

A drain pipe 115*a* is provided between the partition plate 115 and the polishing-and-cleansing solution storage tank 184 so that the abrading solution and the polishing-and-cleansing solution can be drained from the surface treatment compartment 113 to the polishing-and-cleansing solution storage tank 184 through the drain pipe 115*a*. A shielding cover 119 is mounted to the turntable 161 to enclose the pulleys and belts arranged above the turntable 161, thereby protect them from the abrading solution and the polishing-and-cleansing solution.

Next, operation of the bowling ball surface treatment device in accordance with the first embodiment will be described in detail. As shown in FIGS. 1 and 2, the bowling ball B targeted for a surface treatment is first put into the retainer rim 122 of the arm member 121 while the arm member 121 stays in the first position indicated by a chain line in FIG. 2, so that the bowling ball B can be supported on the temporary support disc 140 in the temporary waiting region.

If a start button is pressed down in this state, the control board 116 energizes the arm drive motor 131 and the disc drive motor 163 arranged within the drive compartment 114. As the arm drive motor 131 begins to turn, the eccentric cam 132*a* is rotated to thereby cause the swing lever 132*b* to be repeatedly swung in forward and reverse directions. Concurrently, the arm member 121 repeats swing movement about the arm rotation shaft 124, whereby the bowling ball B contained in the retainer rim 122 is repeatedly displaced from the temporary waiting region to the surface treatment region and vice versa. In the surface treatment region, the bowling ball B is supported on one of the first to fourth surface treatment discs 151-154.

As the disc drive motor 163 begins to turn, the temporary support disc 140 is rotated about the center shaft 140*a* by means of the pulleys 164*a* and 164*b* and the belt 164*c*. At the same moment, the first to fourth surface treatment discs 151-154 are rotated about the center shafts 151*a*-154*a* by means of the driving pulleys 165*a* and 168*a*, the driven pulleys 165*b* and 168*b* and the belts 165*c*-168*c*.

Thus, the bowling ball B makes frictional contact with the rubbing fabric 174*b* of the temporary support disc 140 in the temporary waiting region and the abrasive fabric 174*a* or the rubbing fabric 174*b* of one of the first to fourth surface treatment discs 151-154 in the surface treatment region. When the bowling ball B is displaced between the temporary waiting region and the surface treatment region, it is rotatingly driven by different portions of the temporary support disc 140 and one of the surface treatment discs 151-154. This allows the bowling ball B to be rolled in many different directions about continuously varying rotational axes and, eventually, the whole surface of the bowling ball B is evenly abraded, polished or cleansed with a high degree of roundness.

More specifically, as illustrated in FIG. 5, if the bowling ball B makes contact with the first surface treatment disc 151 at point S1 in the surface treatment region during clockwise rotation of the temporary support disc 140 and the first surface treatment disc 151, the bowling ball B is rotated about a generally horizontal axis by a spinning force of the first surface treatment disc 151 so that a surface treatment (abrading, polishing or cleansing) can be carried out for a strip-like circumferential contact area indicated by "a"

Referring to FIG. 6, if the bowling ball B is displaced to the center of the first surface treatment disc 151 by the swing movement of the arm member 121 and makes contact with the first surface treatment disc 151 at point S2, the bowling ball B is rotated about a generally vertical axis together with the first surface treatment disc 151, during which time little spinning force is applied to the bowling ball B and therefore no meaningful surface treatment is carried out.

Referring to FIG. 7, if the bowling ball B is further moved past the center of the first surface treatment disc 151 by the swing movement of the arm member 121 and makes contact with the first surface treatment disc 151 at point S3, the bowling ball B is rotated again about a generally horizontal axis by a spinning force of the first surface treatment disc 151 so that a surface treatment can be carried out for a strip-like circumferential contact area indicated by "b"

In the course of displacement of the bowling ball B from point S1 to point S2 and then to point S3, the spinning force applied to the bowling ball B by the first surface treatment disc 151 is gradually decreased to nearly zero and then gradually increased. This is because the circumferential speed of the first surface treatment disc 151 varies with the radial positions thereof. More importantly, the direction in which the bowling ball B is spun by the first surface treatment disc 151 at point S1 becomes reversed at point S3. Based on this principle, the bowling ball B is caused to rotate randomly in many different directions, whereby the entire surface areas of the bowling ball B are surface-treated evenly and uniformly.

Referring to FIGS. 8 through 10, if the bowling ball B is displaced to above the temporary support disc 140 by the swing movement of the arm member 121 and makes contact with the temporary support disc 140 sequentially at points S4, S5 and S6 in the temporary waiting region, the bowling ball B undergoes a severe change in rolling direction and speed. This is because the temporary support disc 140 has a smaller diameter (i.e., circumferential speed) than that of the first surface treatment disc 151 and tends to apply a brake force to the bowling ball B.

Although the temporary support disc 140 is rotatably designed in the illustrated embodiment, it may be a fixed member having a disc-shape or other shapes. Furthermore, unlike the illustrated embodiment, the temporary support disc 140 may have no polishing function because the major role of the temporary support disc 140 is to change the rolling direction of the bowling ball B.

The surface treatment operation as set forth above is repeatedly carried out as the bowling ball B is reciprocatingly displaced between the surface treatment region and the temporary waiting region by the swing movement of the arm member 121. In this process, the rolling direction of the bowling ball B is vigorously changed by the difference in circumferential speed, magnitude of spinning force and direction of spinning force in different portions of the temporary support disc 140 and the first surface treatment disc 151. As a consequence, the bowling ball B is evenly surface-treated with a high degree of roundness.

In the above description, the bowling ball B has been surface-treated using the first surface treatment disc 151. Since the abrasive fabric 174*a* attached to the first surface treatment disc 151 has a large grain size, the bowling ball B has been roughly abraded by the first surface treatment disc 151. In order to perform other kinds of surface treatments than the above, e.g., medium abrading, fine abrading and polishing, one of the second to fourth surface treatment discs 152-154 needs to be placed in the surface treatment region.

More specifically, the intermittent drive motor 171 begins to rotate under a control of the control board 116. At this time, the solenoid 173 is energized to retract the retractable plunger 173*a* out of engagement with the positioning hole 161*a*, permitting free revolution of the turntable 161. Rotation of the intermittent drive motor 171 is transferred to the hollow shaft 162 of the turntable 161 through the pulleys 172*a* and 172*b* and the belt 172*c*, thereby revolving the turntable 161 into a target angular position so that one of the second to fourth surface treatment discs 152-154 can be placed in the surface treatment region. Then, the solenoid 173 is de-energized to allow the retractable plunger 173*a* to be extended by a resilient force of a spring (not shown) into engagement with the corresponding one of the positioning holes 161*a*-161*d*, whereby the turntable 161 is held against any revolution ant the of the second to fourth surface treatment discs 152-154 is kept temporary in the treatment region.

In case the second surface treatment disc 152 having the abrasive fabric 174*a* of a medium grain size is placed in the surface treatment region, the bowling ball B is abraded with a medium roughness by the second surface treatment disc 152. If the third surface treatment disc 153 having the abrasive fabric 174*a* of a fine grain size is placed in the surface treatment region, the bowling ball B is finely abraded by the third surface treatment disc 153. On the other hand, if the fourth surface treatment disc 154 having the rubbing fabric 174*b* made of cotton is placed in the surface treatment region, the bowling ball B is polished by the fourth surface treatment disc 154 that rotates faster than the remaining surface treatment discs 151-153. The fourth surface treatment disc 154 is also used in cleansing the bowling ball B.

In this way, while shuttling between the surface treatment region and the temporary waiting region, the bowling ball B is abraded, polished or cleansed by one or more of the first to fourth surface treatment discs 151-154. In abrading, polishing or cleansing the bowling ball B, the first to fourth surface treatment discs 151-154 may be used independently or in combination depending on the user's desire.

During the time when the bowling ball B is abraded with one of the first to third surface treatment discs 151-153, the abrading solution pump 185 is operated so that the abrading solution in the tank 183 can be pressurized and sprayed toward the bowling ball B through the abrading solution spray nozzle 181. The abrading solution thus sprayed helps to assure an efficient abrading operation, on one hand, and dissipates heat generated in the abrading process, on the other hand.

Furthermore, during the time when the bowling ball B is polished or cleansed with the fourth surface treatment disc 154, the polishing-and-cleansing solution pump 186 is operated so that the polishing-and-cleansing solution, i.e., water, in the tank 184 can be pressurized and sprayed toward the bowling ball B through the polishing-and-cleansing solution spray nozzle 182. The polishing-and-cleansing solution thus sprayed helps to perform a polishing or cleansing operation in an efficient manner.

Second Embodiment

FIGS. 11 and 12 show a bowling ball surface treatment device in accordance with a second embodiment of the present invention. As shown in these figures, the bowling ball surface treatment device of the second embodiment includes a housing 210 having an access opening 211 through which a bowling ball B is put into or taken out from the housing 210. The access opening 211 is openably closed by a lid 212. Within the housing 210, there are provided a surface treatment compartment 213 in which the bowling ball B is abraded, polished or cleansed when it is inserted through the access opening 211 and a drive compartment 214 which accommodates various drive units. The surface treatment compartment 213 and the drive compartment 214 are arranged one above the other and isolated from each other by a partition plate 215.

A control board 216 for controlling the bowling ball surface treatment device is attached to an internal side surface of the housing 210, whereas a series of push buttons 217 for operation of the control board 216 and a timer 218 are arranged on an external side surface of the housing 210 in alignment with the control board 216.

Within the surface treatment compartment 213 of the housing 210, there is provided a ball displacing means for holding the bowling ball B in a rotatable manner and displacing the bowling ball B between a temporary waiting region in which the bowling ball B is subject to no significant surface treatment and a surface treatment region in which the bowling ball B is subject to a surface treatment such as abrading, polishing or cleaning. The ball displacing means includes an arm member 221 for holding the bowling ball B in a rotatable manner. The arm member 221 is provided at its distal end with a retainer rim 222 for rotatably receiving the bowling ball B. The retainer rim 222 has an inner diameter far greater than the bowling ball B such that the bowling ball B can be freely rotated within the retainer rim 222. A shock-absorbing member 223 made of, e.g., a spongy material, is attached to an inner circumferential surface of the retainer rim 222.

The arm member 221 is provided at its proximal end with an arm rotation shaft 224 extending downwardly in a vertical direction. The arm rotation shaft 224 is mounted to the partition plate 215 for rotation about a vertical axis. Thus, the arm member 221 is allowed to make a swing movement together with the arm rotation shaft 224 within a predetermined angular extent.

The ball displacing means further includes an arm drive means for repeatedly reciprocating the arm member 221 between a first position (indicated by a single-dotted chain line in FIG. 12) corresponding to the temporary waiting region and a second position (indicated by a solid line in FIG. 12) corresponding to the surface treatment region.

In this regard, the temporary waiting region is a spatial region lying just below the retainer rim 222 when the arm member 221 is in the first position (chain line position), and the surface treatment region is a spatial region lying just blow the retainer rim 222 when the arm member 221 is in the second position (solid line position).

The arm drive means for repeatedly reciprocating the arm member 221 includes an arm drive motor 231 provided within the drive compartment 214 and a motion converter mechanism 232 for converting rotation of the arm drive motor 231 to forward and reverse angular rotation of the arm rotation shaft 224. The motion converter mechanism 232 of the present embodiment is structurally and functionally the same as that of the first embodiment set forth above.

By virtue of the motion converter mechanism 232, rotation of the arm drive motor 231 is converted to a swing motion of the arm member 221 about the arm rotation shaft 224 between the first and second positions. This reciprocatingly displaces the bowling ball B from the temporary waiting region to the surface treatment region and vice versa. Operation of the arm drive motor 231 is controlled by the control board 216. Preferably, the arm drive motor 231 is controlled to turn at such a speed that the arm member 221 can make one reciprocating swing motion every 1-3 seconds.

A temporary support disc 240 is arranged in the temporary waiting region of the surface treatment compartment 213. A surface treatment disc 251 having a diameter far greater than that of the temporary support disc 240 is arranged in the surface treatment region in a spaced-apart relationship with the temporary support disc 240. The temporary support disc 240 and the surface treatment disc 251 are adapted to support a lower surface of the bowling ball B and are rotatable about the corresponding one of center shafts 240*a* and 251*a* extending downwardly in a vertical direction. The respective center shafts 240*a* and 251*a* of the temporary support disc 240 and the surface treatment disc 251 are rotatably fitted to the partition plate 215. The center shaft 240*a* of the temporary support disc 240 extends downwardly through the partition plate 215 into the drive compartment 214.

The temporary support disc 240 and the surface treatment disc 251 are rotatingly driven by virtue of a disc drive means provided within the drive compartment 214. The disc drive means includes a disc drive motor 263 arranged in the drive compartment 214 for rotating the center shaft 240*a* of the temporary support disc 240. Rotation of the disc drive motor 263 is transferred to the center shaft 240*a* of the temporary support disc 240 through a power transmission mechanism that consists of a pair of pulleys 264*a* and 264*b* and a belt 264*c* wound therearound.

A driving pulley 265*a* is fixedly secured to the center shaft 240*a* of the temporary support disc 240 and is operatively connected, by means of a belt 265*c*, to a driven pulley 265*b* fixed to the center shaft 251*a* of the surface treatment disc 251. Thus, upon rotation of the disc drive motor 263, the temporary support disc 240 and the surface treatment disc 251 are rotated simultaneously.

The disc drive means noted above serves to rotate the temporary support disc 240 and the surface treatment disc 251 at a high speed, thereby causing the bowling ball B to be rotatingly driven by one of the temporary support disc 240 and the surface treatment disc 251 in the temporary waiting region or the surface treatment region. Operation of the disc drive means is controlled by the control board 216 in the manner as preset by use of the push buttons 217. It would be preferred that the temporary support disc 240 and the surface treatment disc 251 are rotated at a speed of about 500-1,200 rpm.

Surface treatment elements for making frictional contact with the surface of the bowling ball B to perform a surface treatment is replaceably attached to the top surfaces of the temporary support disc 240 and the surface treatment disc 251. In the present embodiment, the surface treatment elements are comprised of a circular abrasive fabric 274*a* replaceably attached to the surface treatment disc 251 and a circular rubbing fabric 274*b* replaceably attached to the temporary support disc 240. A rubbing fabric (not shown) having the same diameter as that of the abrasive fabric 274*a* is prepared separately for attachment to the surface treatment disc 251 in a polishing or cleaning process. The abrasive fabric 274*a* is made of a sandpaper coated with abrasive grits or the like, which exhibits increased abrading performance, and the rubbing fabric 274*b* is made of a woven cotton fabric or the like, which shows increased polishing and cleaning performance. The abrasive fabric 274*a* attached to the surface treatment disc 251 is used in abrading the bowling ball B, and the rubbing fabric 274*b* attached to the temporary support disc 240 serves primarily as a friction member.

Shock-absorbing members 275 made of, e.g., a sponge, are provided between the respective discs 240 and 251 and the respective fabrics 274*a* and 274*b*. The shock-absorbing members 275 serve to absorb a shock which would be generated in the process of abrading, polishing or cleansing the bowling ball B and also serve to increase a contact area between the bowling ball B and the respective fabrics 274*a* and 274*b*. The shock-absorbing members 275 are replaceably attached to the respective discs 240 and 251 by means of a Velcro fastener or other suitable fastener means and, similarly, the respective abrasive and rubbing fabrics 274*a* and 274*b* are replaceably attached to the corresponding shock-absorbing members 275 by means of a Velcro fastener or other suitable fastener means.

In the present embodiment, the bowling ball surface treatment device further includes a surface treatment solution supply means for supplying surface treatment solution to the bowling ball B while the latter is subject to a surface treatment. The surface treatment solution supply means includes an abrading solution supply device and a polishing-and-cleansing solution supply device. The abrading solution supply device includes an abrading solution spray nozzle 281 attached to the lid 212 for spraying abrading solution, e.g., a mixture of fluid and fine grits, toward the bowling ball B, an abrading solution storage tank 283 arranged within the drive compartment 214, and an abrading solution pump 285 arranged within the drive compartment 214 for feeding pressurized abrading solution to the abrading solution spray nozzle 281. The polishing-and-cleansing solution supply device includes a polishing-and-cleansing solution spray nozzle 282 attached to the lid 212 for spraying polishing-and-cleansing solution, e.g., water, toward the bowling ball B, a polishing-and-cleansing solution storage tank 284 arranged within the drive compartment 214, and a polishing-and-cleansing solution pump 286 arranged within the drive compartment 214 for feeding pressurized polishing-and-cleansing solution to the polishing-and-cleansing solution spray nozzle 282.

A drain pipe 215*a* is provided between the partition plate 215 and the polishing-and-cleansing solution storage tank 284 so that the abrading solution and the polishing-and-cleansing solution can be drained from the surface treatment compartment 213 to the polishing-and-cleansing solution storage tank 284 through the drain pipe 215*a*. A shielding cover 219 is mounted to the partition plate 215 to enclose the pulleys and belts arranged above the partition plate 215, thereby protect them from the abrading solution and the polishing-and-cleansing solution.

Next, operation of the bowling ball surface treatment device in accordance with the second embodiment will be described in detail. As shown in FIGS. 11 and 12, the bowling ball B targeted for a surface treatment is first put into the retainer rim 222 of the arm member 221 while the arm member 221 stays in the first position indicated by a chain line in FIG. 12, so that the bowling ball B can be supported on the temporary support disc 240 in the temporary waiting region.

If a start button is pressed down in this state, the control board 216 energizes the arm drive motor 231 and the disc drive motor 263 arranged within the drive compartment 214. As the arm drive motor 231 begins to turn, the arm member 221 is swung to the second position indicated by a solid line in FIG. 12. Such swing movement of the arm member 221 is repeated in forward and reverse directions about the arm rotation shaft 224, whereby the bowling ball B contained in the retainer rim 222 is repeatedly displaced from the temporary waiting region to the surface treatment region and vice versa. In the surface treatment region, the bowling ball B is supported on the surface treatment disc 251.

As the disc drive motor 263 begins to turn, the temporary support disc 240 is rotated about the center shaft 240*a* by means of the pulleys 264*a* and 264*b* and the belt 264*c*. At the same moment, the surface treatment disc 251 is rotated about the center shaft 251*a* by means of the driving pulley 265*a*, the driven pulley 265*b* and the belt 265*c*.

Thus, the bowling ball B makes frictional contact with the rubbing fabric 274*b* of the temporary support disc 240 in the temporary waiting region and the abrasive fabric 274*a*, or a rubbing fabric replaced with the abrasive fabric 274*a*, of the surface treatment disc 251 in the surface treatment region. When the bowling ball B is displaced between the temporary waiting region and the surface treatment region, it is rotatingly driven by different portions of the temporary support disc 240 and the surface treatment disc 251. This allows the bowling ball B to be rolled in many different directions about continuously varying rotational axes and, eventually, the whole surface of the bowling ball B is evenly abraded, polished or cleansed with a high degree of roundness.

Although the temporary support disc 240 is rotatably designed in the illustrated embodiment, it may be a fixed member having a disc-shape or other shapes. Furthermore, unlike the illustrated embodiment, the temporary support disc 240 may have no polishing function because the major role of the temporary support disc 240 is to change the rolling direction of the bowling ball B.

The surface treatment operation as set forth above is repeatedly carried out as the bowling ball B is reciprocatingly displaced between the surface treatment region and the temporary waiting region by the swing movement of the arm member 221. In this process, the rolling direction of the bowling ball B is vigorously changed by the difference in circumferential speed, magnitude of spinning force and direction of spinning force in different portions of the temporary support disc 240 and the surface treatment disc 251. As a consequence, the bowling ball B is evenly surface-treated with a high degree of roundness.

During the time when the bowling ball B is abraded or polished with the surface treatment disc 251, the abrading solution in the tank 283 or the polishing-and-cleansing solution in the tank 184 are pressurized and sprayed toward the bowling ball B through the spray nozzles 281 and 282.

Third Embodiment

FIGS. 13 through 17 show a bowling ball surface treatment device in accordance with a third embodiment of the present invention. As shown in these figures, the bowling ball surface treatment device of the second embodiment includes a housing 310 having an access opening 311 through which a bowling ball B is put into or taken out from the housing 310. The access opening 311 is openably closed by a lid 312. Within the housing 310, there are provided a surface treatment compartment 313 in which the bowling ball B is abraded, polished or cleansed when it is inserted through the access opening 311 and a drive compartment 314 which accommodates various drive units. The surface treatment compartment 313 and the drive compartment 314 are arranged one above the other and isolated from each other by a partition plate 315.

A control board 316 for controlling the bowling ball surface treatment device is attached to an internal side surface of the housing 310, whereas a series of push buttons 317 for operation of the control board 316 and a timer 318 are arranged on an external side surface of the housing 310 in alignment with the control board 316.

Within the surface treatment compartment 313 of the housing 310, there is provided a ball displacing means for holding the bowling ball B in a rotatable manner and displacing the bowling ball B between a temporary waiting region in which the bowling ball B is subject to no significant surface treatment and a surface treatment region in which the bowling ball B is subject to a surface treatment such as abrading, polishing or cleaning. The ball displacing means includes an arm member 321 for holding the bowling ball B in a rotatable manner. The arm member 321 is provided at its distal end with a retainer rim 322 for rotatably receiving the bowling ball B. The retainer rim 322 has an inner diameter far greater than the bowling ball B such that the bowling ball B can be freely rotated within the retainer rim 322. A shock-absorbing member 323 made of, e.g., a spongy material, is attached to an inner circumferential surface of the retainer rim 322.

The arm member 321 is provided at its proximal end with an arm rotation shaft 324 extending downwardly in a vertical direction. The arm rotation shaft 324 is mounted to the partition plate 315 for rotation about a vertical axis. Thus, the arm member 321 is allowed to make a swing movement together with the arm rotation shaft 324 within a predetermined angular extent.

The ball displacing means further includes an arm drive means for repeatedly reciprocating the arm member 321 between a first position (indicated by a single-dotted chain line in FIG. 14) corresponding to the temporary waiting region and a second position (indicated by a solid line in FIG. 14) corresponding to the surface treatment region.

In this regard, the temporary waiting region is a spatial region lying just below the retainer rim 322 when the arm member 321 is in the first position (chain line position), and the surface treatment region is a spatial region lying just blow the retainer rim 322 when the arm member 321 is in the second position (solid line position).

The arm drive means for repeatedly reciprocating the arm member 321 includes an arm drive motor 331 provided within the drive compartment 314 and a motion converter mechanism 332 for converting rotation of the arm drive motor 331 to forward and reverse angular rotation of the arm rotation shaft 324. The motion converter mechanism 332 of the present embodiment is structurally and functionally the same as that of the first embodiment set forth above.

By virtue of the motion converter mechanism 332, rotation of the arm drive motor 331 is converted to a swing motion of the arm member 321 about the arm rotation shaft 324 between the first and second positions. This reciprocatingly displaces the bowling ball B from the temporary waiting region to the surface treatment region and vice versa. Operation of the arm drive motor 331 is controlled by the control board 316. Preferably, the arm drive motor 331 is controlled to turn at such a speed that the arm member 321 can make one reciprocating swing motion every 1-3 seconds.

A support disc 351 having a diameter large enough to cover the temporary waiting region and the surface treatment region is arranged within the surface treatment compartment 313. The support disc 351 is adapted to support a lower surface of the bowling ball B and is rotatable about a center shaft 351*a* extending downwardly in a vertical direction. The center shaft 351*a* of the support disc 351 is rotatably fitted to the partition plate 315 and extends downwardly through the partition plate 315 into the drive compartment 314. In this embodiment, the support disc has a center axis that lies within the temporary waiting region. A center portion of the support disc is located just below the temporary waiting region and a peripheral portion of the support disc is located just below the surface treatment region.

The support disc 351 is rotatingly driven by virtue of a disc drive means provided within the drive compartment 314. The disc drive means includes a disc drive motor 363 arranged in the drive compartment 314 for rotating the center shaft 351*a* of the support disc 351. Rotation of the disc drive motor 363 is transferred to the center shaft 351*a* of the support disc 351 through a power transmission mechanism that consists of a pair of pulleys 364*a* and 364*b* and a belt 364*c* wound therearound.

The disc drive means noted above serves to rotate the support disc 351 at a high speed, thereby causing the bowling ball B to be rotatingly driven by the support disc 351 in the temporary waiting region or the surface treatment region. Operation of the disc drive means is controlled by the control board 316 in the manner as preset by use of the push buttons 317. It would be preferred that the support disc 351 is rotated at a speed of about 200-900 rpm.

Surface treatment elements for making frictional contact with the surface of the bowling ball B to perform a surface treatment is replaceably attached to the top surface of the support disc 351. In the present embodiment, the surface treatment elements include a circular abrasive fabric 374 replaceably attached to the support disc 351. A rubbing fabric (not shown) having the same diameter as that of the abrasive fabric 374 is prepared separately for attachment to the support disc 351 in a polishing or cleaning process. The abrasive fabric 374 is made of a sandpaper coated with abrasive grits or the like, which exhibits increased abrading performance, and the rubbing fabric is made of a woven cotton fabric or the like, which shows increased polishing and cleaning performance. The abrasive fabric 374 is used in abrading the bowling ball B, while the rubbing fabric is used in polishing or cleaning the bowling ball B.

A shock-absorbing member 375 made of, e.g., a sponge, is provided between the support disc 351 and the abrasive fabric 374. The shock-absorbing member 375 serves to absorb a shock which would be generated in the process of abrading, polishing or cleansing the bowling ball B and also serves to increase a contact area between the bowling ball B and the abrasive fabric 374 or the rubbing fabric. The shock-absorbing member 375 is replaceably attached to the support disc 351 by means of a Velcro fastener or other suitable fastener means.

In the present embodiment, the bowling ball surface treatment device further includes a surface treatment solution supply means for supplying surface treatment solution to the bowling ball B while the latter is subject to a surface treatment. The surface treatment solution supply means includes an abrading solution supply device and a polishing-and-cleansing solution supply device. The abrading solution supply device includes an abrading solution spray nozzle 381 attached to the lid 312 for spraying abrading solution, e.g., a mixture of fluid and fine grits, toward the bowling ball B, an abrading solution storage tank 383 arranged within the drive compartment 314, and an abrading solution pump 385 arranged within the drive compartment 314 for feeding pressurized abrading solution to the abrading solution spray nozzle 381. The polishing-and-cleansing solution supply device includes a polishing-and-cleansing solution spray nozzle 382 attached to the lid 312 for spraying polishing-and-cleansing solution, e.g., water, toward the bowling ball B, a polishing-and-cleansing solution storage tank 384 arranged within the drive compartment 314, and a polishing-and-cleansing solution pump 386 arranged within the drive compartment 314 for feeding pressurized polishing-and-cleansing solution to the polishing-and-cleansing solution spray nozzle 382.

A drain pipe 315*a* is provided between the partition plate 315 and the polishing-and-cleansing solution storage tank 384 so that the abrading solution and the polishing-and-cleansing solution can be drained from the surface treatment compartment 313 to the polishing-and-cleansing solution storage tank 384 through the drain pipe 315*a*. A shielding cover 319 is mounted to the partition plate 315 to protect a bearing from the abrading solution and the polishing-and-cleansing solution.

Next, operation of the bowling ball surface treatment device in accordance with the third embodiment will be described in detail. As shown in FIGS. 13 and 14, the bowling ball B targeted for a surface treatment is first put into the retainer rim 322 of the arm member 321 while the arm member 321 stays in the first position indicated by a chain line in FIG. 14, so that the bowling ball B can be supported on a center portion of the support disc 351 in the temporary waiting region.

If a start button is pressed down in this state, the control board 316 energizes the arm drive motor 331 and the disc drive motor 363 arranged within the drive compartment 314. As the arm drive motor 331 begins to turn, the arm member 321 is swung to the second position indicated by a solid line in FIG. 14. Such swing movement of the arm member 321 is repeated in forward and reverse directions about the arm rotation shaft 324, whereby the bowling ball B contained in the retainer rim 322 is repeatedly displaced from the temporary waiting region to the surface treatment region and vice versa In the surface treatment region, the bowling ball B is supported on a peripheral portion of the support disc 351. As the disc drive motor 363 begins to turn, the support disc 351 is rotated about the center shaft 351*a* by means of the pulleys 364*a* and 364*b* and the belt 364*c*.

Thus, the bowling ball B makes frictional contact with the abrasive fabric 374, or a rubbing fabric replaced with the abrasive fabric 374, of the support disc 351 in the surface treatment region and the temporary waiting region. When the bowling ball B is displaced between the temporary waiting region and the surface treatment region, it is rotatingly driven by different portions of the support disc 351 in different directions and at different speeds. This allows the bowling ball B to be rolled in many different directions about continuously varying rotational axes and, eventually, the whole surface of the bowling ball B is evenly abraded, polished or cleansed with a high degree of roundness.

More specifically, as illustrated in FIG. 15, if the bowling ball B makes contact with the support disc 351 at point S1 in the surface treatment region during clockwise rotation of the support disc 351, the bowling ball B is rotated about a generally horizontal axis by a spinning force of the support disc 351 so that a surface treatment (abrading, polishing or cleansing) can be carried out for a strip-like circumferential contact area indicated by "a". In this regard, the bowling ball B is abraded if the abrasive fabric 374 is attached to the support disc 351. Polishing or cleansing will occur if the abrasive fabric 374 is replaced with a cotton-made rubbing fabric.

Referring to FIG. 16, if the bowling ball B is displaced to the center portion of the support disc 351 by the swing movement of the arm member 321 and makes contact with the support disc 351 at point S2, the bowling ball B is rotated about a generally vertical axis together with the support disc 351, during which time little spinning force is applied to the bowling ball B and therefore no meaningful surface treatment is carried out.

Referring to FIG. 17, if the bowling ball B is returned back to the peripheral portion of the support disc 351 by the swing movement of the arm member 321 and makes contact with the support disc 351 at point S1, the bowling ball B is rotated again about a generally horizontal axis by a spinning force of the support disc 351 so that a surface treatment can be carried out for a strip-like circumferential contact area indicated by "b".

In the course of displacement of the bowling ball B from point S1 to point S2, the spinning force applied to the bowling ball B by the support disc 351 is gradually decreased to nearly zero. This is because the circumferential speed of the support disc 351 varies with the radial positions thereof. Based on this principle, the bowling ball B is caused to rotate randomly in many different directions as it shuttles between the temporary waiting region and the surface treatment region, whereby the entire surface areas of the bowling ball B are surface-treated evenly and uniformly with a high degree of roundness.

During the time when the bowling ball B is abraded or polished with the support disc 351, the abrading solution in the tank 383 or the polishing-and-cleansing solution in the tank 384 are pressurized and sprayed toward the bowling ball B through the spray nozzles 381 and 382.

Although the arm member 121, 221 or 321 with the retainer rim 122, 222 or 322 is employed as an example of the ball displacing means in the foregoing embodiments, it should be understood that other ball displacing means, e.g., a linear motion device with a ball retainer or a hydraulic cylinder having a ball retainer may be alternatively used.

Industrial Applicability

As fully described above, the bowling ball surface treatment device in accordance with the present invention makes it possible to evenly abrade, polish or cleanse the whole surface of the bowling ball with increased roundness. Furthermore, the bowling ball surface treatment device of the present invention is relatively simple in structure and shows improved durability for an extended period of operating time.

The invention claimed is:

1. A bowling ball surface treatment device for abrading, polishing or cleansing a bowling ball, said device comprising:

a housing;

a ball displacing means movably mounted to the housing for holding the bowling ball in a rotatable manner and for reciprocatingly displacing the bowling ball between a temporary waiting region and a surface treatment region in which the bowling ball is subject to a surface treatment;

a surface treatment disc means in the surface treatment region for supporting and spinning the bowling ball, the surface treatment disc means arranged such that the bowling ball makes rolling contact with different polishing portions of the surface treatment disc means as the bowling ball is displaced between the temporary waiting region and the surface treatment region, the surface treatment disc means having a surface treatment element for making frictional contact with the bowling ball to abrade, polish or cleanse the bowling ball;

a temporary support means arranged in the temporary waiting region for temporarily supporting a lower surface of the bowling ball when the bowling ball is moved out of the surface treatment region; and a disc drive means for rotating the surface treatment disc means.

2. The bowling ball surface treatment device as recited in claim 1, wherein the surface treatment disc means comprises a plurality of surface treatment discs arranged along an imaginary circle passing through the surface treatment region in such a manner that one of the surface treatment discs is selectively placed in the surface treatment region and wherein the temporary support means comprises a temporary support disc rotatably mounted to the housing and rotatingly driven by the disc drive means, the temporary support disc being surrounded by the surface treatment discs.

3. The bowling ball surface treatment device as recited in claim 2, further comprising a turntable mounted to the housing for rotatably supporting the surface treatment discs at a generally equal interval, the turntable being intermittently revolvable in such a manner that one of the surface treatment discs is selectively brought into the surface treatment region, and an intermittent drive means for intermittently revolving the turntable.

4. The bowling ball surface treatment device as recited in claim 1, wherein the surface treatment disc means comprises a surface treatment disc arranged in the surface treatment region, and wherein the temporary support means comprises a temporary support disc arranged in the temporary waiting region and rotatably driven by the disc drive means.

5. The bowling ball surface treatment device as recited in claim 1, wherein the surface treatment disc means comprises a peripheral portion of a single disc whose center axis lies within the temporary waiting region, and wherein the temporary support means comprises a center portion of the single disc.

6. The bowling ball surface treatment device as recited in claim 1, wherein the ball displacing means comprises an arm member swingable between a first position corresponding to the temporary waiting region and a second position corresponding to the surface treatment region, the arm member having a retainer rim for receiving the bowling ball in a rotatable manner, and an arm drive means for causing the arm member to be repeatedly swung between the first position and the second position.

7. The bowling ball surface treatment device as recited in claim 6, wherein the arm drive means comprises an arm drive motor and a motion converter mechanism for converting rotation of the arm drive motor to swing movement of the arm member.

8. The bowling ball surface treatment device as recited in claim 1, wherein the surface treatment element comprises an abrasive fabric for abrading the bowling ball and a rubbing fabric for polishing or cleansing the bowling ball, the abrasive fabric and the rubbing fabric being replaceably attached to the surface treatment disc means.

9. The bowling ball surface treatment device as recited in claim 1, wherein the temporary support means has a surface treatment element, and the temporary support means and the surface treatment disc means are configured to cause the surface treatment elements to make frictional contact with the bowling ball.

10. The bowling ball surface treatment device as recited in claim 4, wherein said temporary support disc is smaller than said surface treatment disc, and a circumferential speed of the temporary support disc is less than that of said surface treatment disc therefore the temporary support disc is configured for applying a brake force to the bowling ball.

11. The bowling ball surface treatment device as recited in claim 6, wherein said retainer rim has an inner diameter greater than the bowling ball so that the bowling ball is freely rotatable within the retainer rim.

12. A bowling ball surface treatment device for abrading, polishing or cleansing a bowling ball, said device comprising:

a housing;

an arm member for holding the bowling ball in a rotatable manner and for reciprocatingly displacing the bowling ball between a temporary waiting region and a surface treatment region in which the bowling ball is subject to a surface treatment, the arm member being swingable between a first position corresponding to the temporary waiting region and a second position corresponding to the surface treatment region, the arm member having a retainer rim for rotatably receiving the bowling ball;

an arm drive unit for causing the arm member to be repeatedly swung between the first position and the second position;

a plurality of surface treatment discs arranged along an imaginary circle passing through the surface treatment region, each of the surface treatment discs being movable into or out of the surface treatment region and adapted to support the bowling ball when the bowling ball is moved into the surface treatment region, each of the surface treatment discs having a surface treatment element for making factional contact with the bowling ball to abrade, polish or cleanse the bowling ball;

a turntable mounted to the housing for rotatably supporting the surface treatment discs at a generally equal interval, the turntable being intermittently revolvable in such a manner that one of the surface treatment discs is selectively brought into the surface treatment region;

an intermittent drive unit for intermittently revolving the turntable;

a temporary support disc arranged in the temporary waiting region to temporarily support a lower surface of the bowling ball when the bowling ball is moved out of the surface treatment region; and a disc drive unit for rotating the surface treatment discs and the temporary support disc.

13. The bowling ball surface treatment device as recited in claim 12, wherein the surface treatment element comprises an abrasive fabric for abrading the bowling ball and a rubbing fabric for polishing or cleansing the bowling ball, the abrasive fabric and the rubbing fabric being replaceably attached to the surface treatment discs.

14. The bowling ball surface treatment device as recited in claim 12, wherein the temporary support disc has a surface treatment element, and the temporary support disc and the surface treatment discs are configured to cause the surface treatment elements to make frictional contact with the bowling ball.

15. The bowling ball surface treatment device as recited in claim 12, wherein the temporary support disc and the surface treatment discs are rotatable simultaneously upon the rotation of the disc drive unit.

16. The bowling ball surface treatment device as recited in claim 12, wherein said temporary support disc is smaller than each said surface treatment disc, and a circumferential speed of the temporary support disc is less than that of each said surface treatment disc therefore the temporary support disc is configured for applying a brake force to the bowling ball.

17. A ball surface treatment device for treating a ball, said device comprising:

a housing;

a ball displacing unit movably mounted to the housing for holding the ball in a rotatable manner and for reciprocatingly displacing the ball between a temporary waiting region and a surface treatment region in which the ball is subject to a surface treatment;

a support disc unit comprising the temporary waiting region and the surface treatment region for supporting and spinning the ball, wherein the support disc unit is configured to support a lower surface of the ball and is rotatable about a center axis that lies within the temporary waiting region, the support disc unit is arranged such that the ball makes rolling contact with different portions of the support disc unit as the ball is displaced between the temporary waiting region and the surface treatment region, the support disc unit having a surface treatment element for making frictional contact with the ball to treat the ball; and a disc drive unit for driving the support disc unit to rotate.

18. The ball surface treatment device as recited in claim 17, wherein the ball displacing unit includes an arm member and a retainer rim connected to the arm member for receiving the ball, and said retainer rim has an inner diameter greater than the ball so that the ball is freely rotatable within the retainer rim.

* * * * *